United States Patent [19]

Reed

[11] Patent Number: 4,836,300

[45] Date of Patent: Jun. 6, 1989

[54] METHOD OF PERFORMING DRILLING OPERATIONS FROM A DERRICK

[75] Inventor: Lowell M. Reed, Moore, Okla.

[73] Assignee: Parco Mast and Substructures, Inc., Del City, Okla.

[21] Appl. No.: 201,548

[22] Filed: Jun. 2, 1988

Related U.S. Application Data

[62] Division of Ser. No. 922,201, Oct. 23, 1986, Pat. No. 4,796,863.

[51] Int. Cl.[4] ..... E21B 7/00; E21B 15/00; E21B 19/00; B66C 23/60

[52] U.S. Cl. ..... 175/57; 52/633; 254/399

[58] Field of Search ..... 175/57, 85, 202, 203; 414/22; 254/394, 399, 336, 337

[56] References Cited

U.S. PATENT DOCUMENTS

| | | | |
|---|---|---|---|
| 2,187,392 | 1/1940 | Chappell | 254/398 X |
| 2,226,947 | 12/1940 | Sheldon | 254/398 X |
| 3,494,593 | 2/1970 | Blagg | 254/336 |
| 3,658,298 | 4/1972 | Moore et al. | 254/286 |
| 4,390,162 | 6/1983 | Woolslayer | 254/398 |
| 4,423,994 | 1/1984 | Schefers et al. | 175/85 X |

*Primary Examiner*—Stephen J. Novosad

*Attorney, Agent, or Firm*—Head & Johnson

[57] ABSTRACT

The crown block has two parallel clusters of sheaves. In one use the crown block is positioned such that the center of the derrick passes through the axle of one of the clusters and a power cable is threaded through the first cluster of the crown block and the cluster of the travelling block. When one wants to double the mechanical advantage, the crown block unit is shifted so that the center line of the derrick passes midway between the axle of the first cluster and the second cluster of the crown block. For this second use a modified traveling block is used which also has two parallel clusters of sheaves which corresponds to the two parallel cluster of sheaves of the crown block. The power cable is then threaded between the first clusters of the crown block and the traveling block and then through the second sheave cluster of the crown block and the second sheave cluster of the traveling block. The load is connected to a cross member between the two axles of the clusters of the traveling block. This new crown block may be used with a derrick having an upper and lower section in which the upper section is of lesser strength than the lower section. The new crown block may be used at the top of the upper section of the derrick or moved to the top of the lower stronger section.

3 Claims, 4 Drawing Sheets

METHOD OF PERFORMING DRILLING OPERATIONS FROM A DERRICK

This is a divisional of co-pending application Ser. No. 922,201 filed on Oct. 23, 1986, now U.S. Pat. No. 4,796,863.

BACKGROUND OF THE INVENTION

1. Field of the Invention

This invention relates to drilling derricks of the type used to drill oil and gas wells and especially relates to an improved crown block.

In drilling wells into the earth such as those in search of oil, gas or various minerals, it is common practice to provide a drilling derrick. This drilling derrick may be anywhere from twenty to one hundred or more feet in height. It will have what is called a crown block at the top. This crown block will have one or more sheaves over which a cable will be threaded. The cable will extend down to what is called a traveling block which is suspended by the cable underneath the crown block. One end of the cable is connected to the draw works which has a power drum for reeling and unreeling the cable and the other end of the cable is called a deadline and is connected to the deadline anchor.

The load which the traveling block must lift varies from a small amount when lightweight drill pipe in short sections are being lifted to when long sections of heavy duty large diameter casings are being lowered or raised into the well bore. As the crown block at the top of the derrick the entire derrick has to be made strong enough to support the heaviest loads. There are numerous disclosures in the patents and literature which discloses many different types of derricks and their construction, operations and so forth.

2. Description of the Prior Art

Typical of this art are the following patents: U.S. Pat. No. 1,487,608, Rowland, entitled "Crown Block for Well Drilling Apparatus" which has a shaft 4 fixed to the beams 1 for supporting several sheaves of the operating lines. U.S. Pat. No. 1,563,739, Goeser, entitled "Crown Block" has sheaves each mounted on its respective shaft 60 in which the shafts 60 are fixed to the structure. U.S. Pat. No. 2,187,392, Chapel, entitled "Derrick" which shows a pair of crown block units mounted movably on its upper end whereby one of the units may be centered within the derrick to support the drill pipe or tubing while the other unit may be off center free for other work. Each unit is complete in itself including the usual traveling block. U.S. Pat. No. 2,226,947, Sheldon, "Well Drilling Apparatus" which has crown blocks 33 and 34 which are independent of each other and each performs an individual and separate operation. U.S. Pat. No. 3,658,298, Moore et al, entitled "Drilling Rig With Shiftable Crown Blocks", and has two sets of hoisting mechanisms with two crown blocks which are shiftable to enable either block to be positioned over the drill hole. Each crown block has its independent traveling block. U.S. Pat. No. 4,074,774 Brown et al, entitled "Drilling Apparatus", is primarily concerned with an apparatus for drilling a slanting hole. U.S. Pat. No. 4,390,162, Woolslayer, entitled "Infinitely Variable Crown Block Positioning", which as the title indicates has as an object is to provide an oil well drilling derrick with a crown block that can be moved in a straight line into an infinite number of different positions for drilling wells wherever it is desired between opposite sides of the derrick. U.S. Pat. No. 4,423,994, Schefers et al, is entitled "Drilling Rig Equipped With Pairs of Block and Tackle Systems".

SUMMARY OF THE INVENTION

This invention relates to a movable crown block which has two clusters of cable sheaves. Each cluster has a plurality of sheaves having a common axis. The axis of the two clusters are parallel and are supported by a movable or traveling frame which can move along a support frame which is supported from the top of the derrick. In one position the center of the derrick is through the axle of the first sheave cluster. In this first position only one sheave cluster is used and I operate in a substantially normal manner with a conventional traveling block. For heavy loads where I want to increase the mechanical advantage. I move the traveling frame so that the center of the derrick is essentially half way between the two parallel axles of the two clusters. The traveling block is modified to be provided with a pair of parallel sheave clusters which are held together in fixed spaced relation by a cross bar. The live line or cable is threaded first between the first cluster of the crown block and the first cluster of the traveling block and then between the second cluster of the crown block and the second cluster of the traveling block. This gives me double the mechanical advantage of what I would have when I use only one cluster of sheaves with my cable. The load which I lift is connected to the mid point of the cross member mid way between the axles or axis of the two clusters of the traveling block.

My novel crown block is also quite useful with a drilling derrick having a lower portion which is made of sufficient strength to be used in lifting heaviest loads anticipated can be used to lift a much heavier load and an upper portion which is designed with much less strength which can be used for some or most of the lifting but not of sufficient strength for the anticipated heavier loads. I put my crown block at the top portion of the upper portion of the derrick and support a travel block and perform most of the routine drilling operations. However, when it becomes time to lift the heavier load, such as large diameter casing I lower my crown block to the upper end of the high strength lower portion of the derrick and I thread my cable so that I utilize both sheave clusters of the crown block with a like pair of sheave clusters on my modified or improved traveling block to obtain twice the mechanical advantage as when the crown block was at the top of the upper portion of the derrick. This doubling of the mechanical advantage doubles the load which the drawworks can handle.

DETAILED DESCRIPTION OF THE PREFERRED EMBODIMENT

Figure 2:
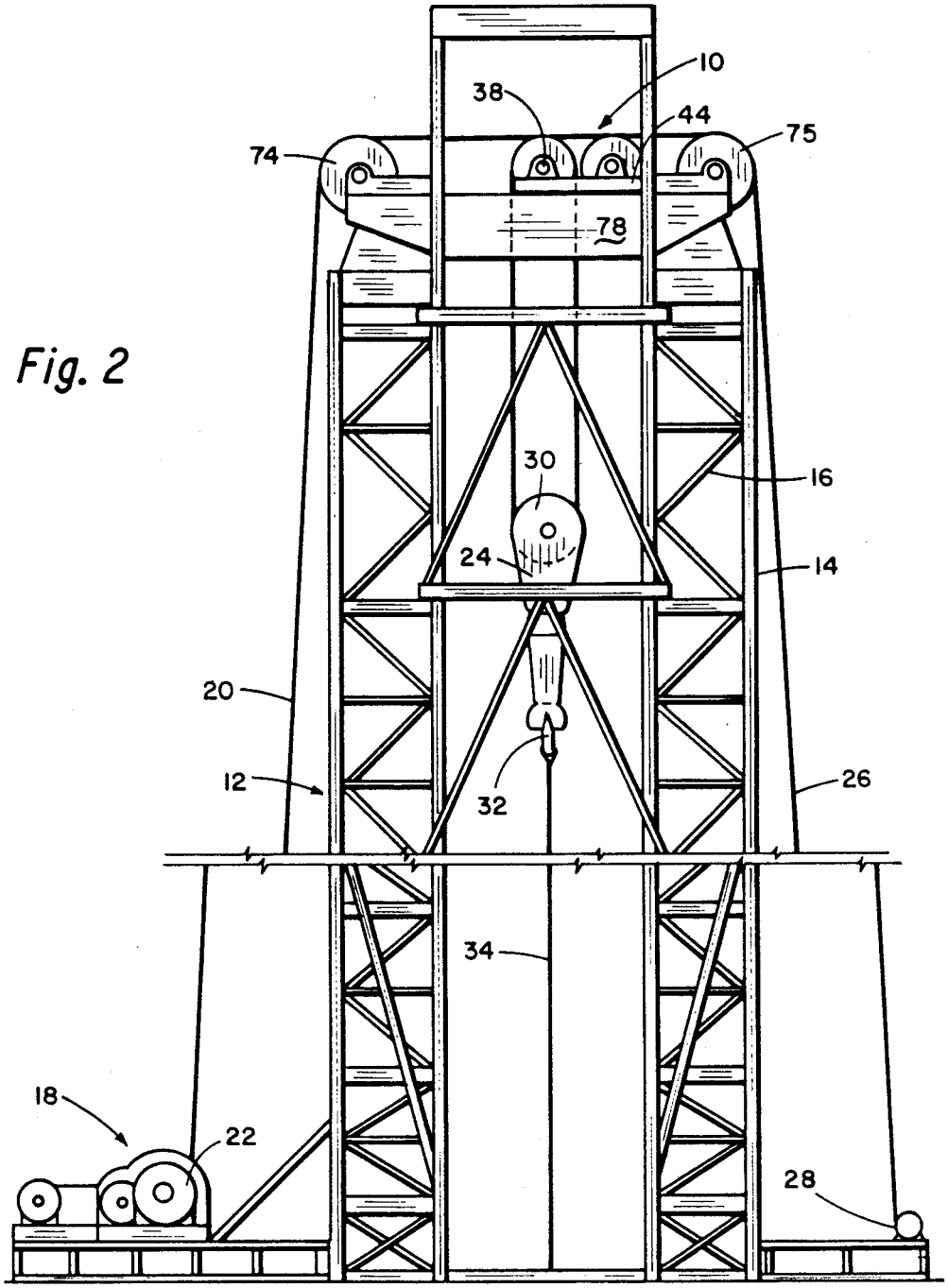
FIG. 2 illustrates the improved crown block assembly in a drilling derrick using only one sheave cluster.

Attention is first directed to FIG. 2 which shows my improved crown block 10 mounted on a derrick 12. The derrick includes legs 14 with interbracing 16. Also shown is drawworks 18 having live cable 20 which is mounted around the drum 22 and driven thereby and extends over the crown block 10 and traveling block 24. The dead line 26 is connected to dead line anchor 28. The traveling block 24 includes a traveling block sheave 30 with swivel and hook unit 32 which supports the load line 34. As is well known the traveling block can be used to raise and lower drill pipe and casing. Of course, the bigger the pipe or casing, and the longer and deeper the hole, the more load the traveling block and lines will have to be able to handle. As is well known when removing tubular goods from a well bore the entire length of the particular tubing string is connected to the traveling block and power is supplied to the cable 20 by the drawworks 18 to raise the traveling block which also raises the pipe that is being removed. If the well is 10,000 feet deep then the block will have to lift over two miles of pipe whose weight can be extremely large. The pipe section is raised as much as the capacity of the derrick will permit then the section of the pipe is clamped near the floor of the derrick, the section of the pipe being removed which is within the derrick is disconnected from the remaining pipe section and is stored. The traveling block is then lowered where it connects onto the pipe section remaining in the bore hole and pulls it to the maximum height and the operation is then repeated until all the drill string is removed. Drilling derricks are well known and contain production and drilling equipment such as drilling engines, auxiliary power units, mud pumping equipment and specialized well servicing units surrounding the derrick. Therefore, it is not necessary to go into the details of construction and operation of these various equipment and services. Rather, the discussion will be concerned more with the novel aspects of the equipment shown in the drawings which includes the crown block 10, its location, modification of the traveling block.

Figure 1:
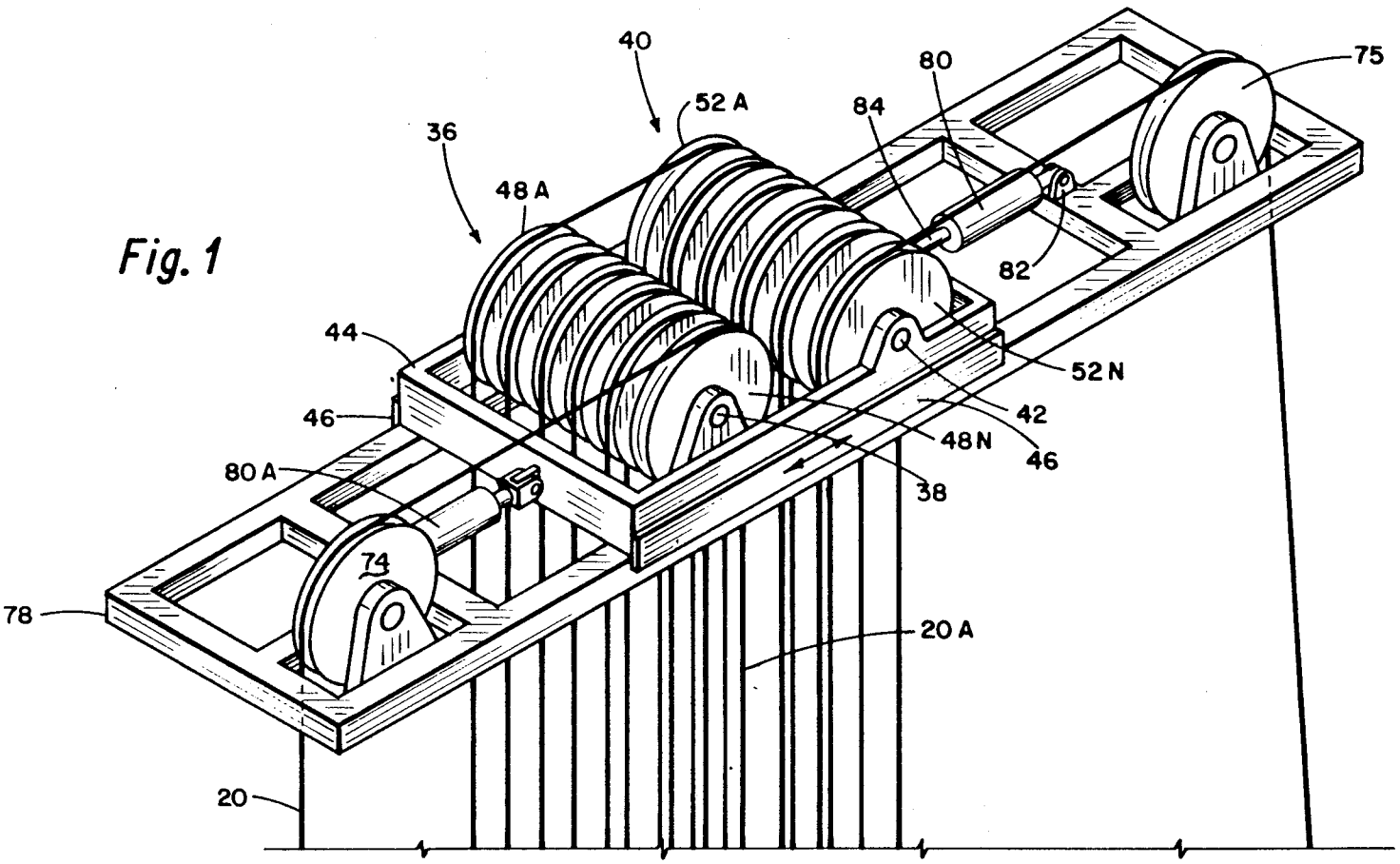
FIG. 1 is an isometric view of the improved ground block of my invention using parallel clusters of sheaves.
Figure 3:
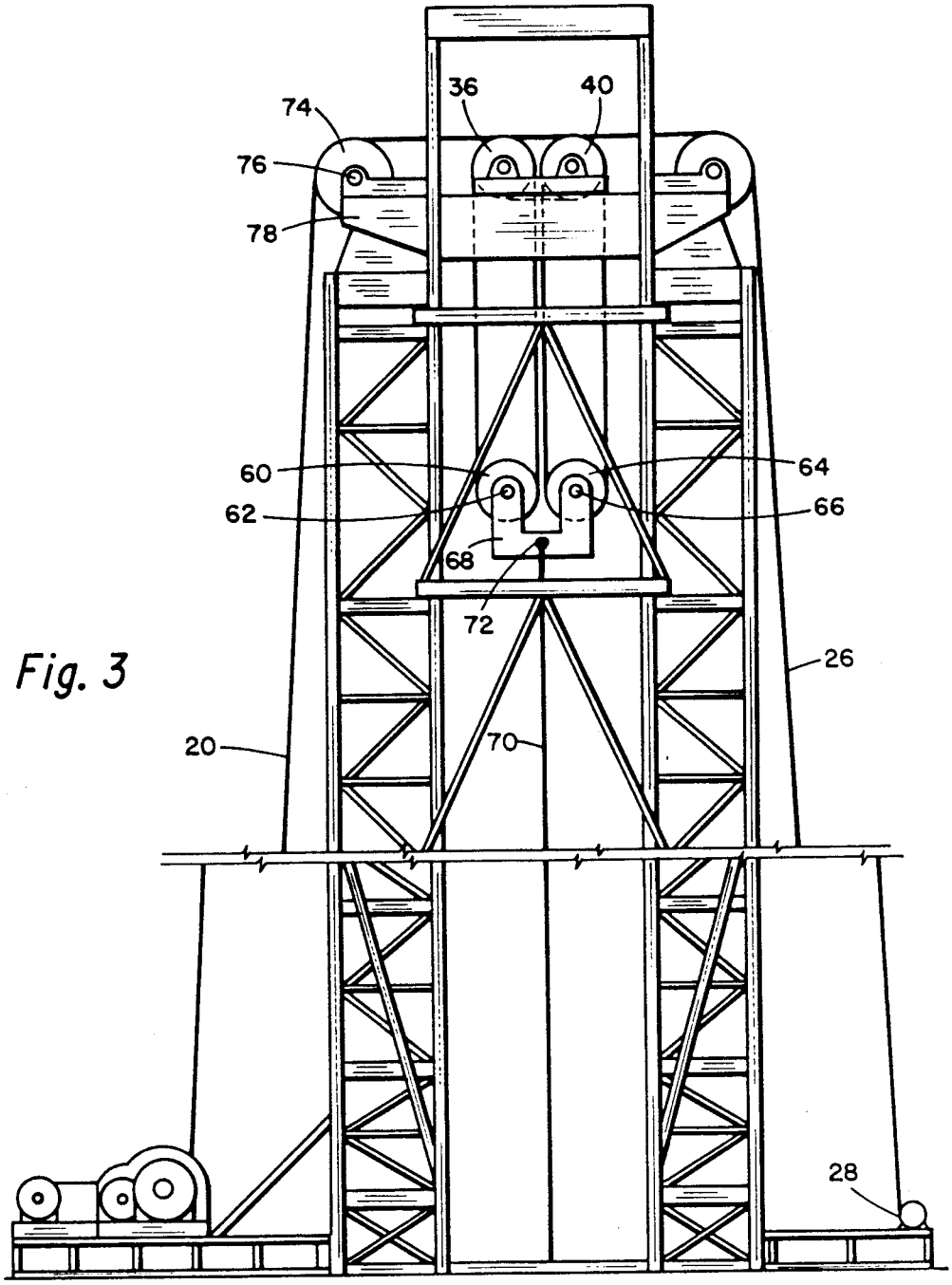
FIG. 3 is similar to FIG. 2 except that the crown block has been moved so that the center line of the derrick falls between the two sheave clusters.

Attention is next directed to FIG. 1 which shows in detail my improved crown block which was illustrated as crown block 10 of FIG. 1. Shown thereon is a double cluster of sheaves which includes a first sheave cluster 36 having an axle 38 and a second sheaves cluster 40 having an axle 42. Axles 38 and 42 are supported from crown block traveling frame 44 which has guide rails 46 on either side. Traveling frame 44 is supported on support frame 78 which is secured in the derrick. The axis of axles 38 and 42 are essentially parallel. The first cluster comprises a plurality of sheaves 48A to 48N mounted on common axle 38. The second cluster 40 includes a plurality of sheaves from 52A to 52N all mounted on a common axle 42. Each individual sheave can be a conventional type to receive the cable 20 in a known manner. The crown block position of FIG. 1 and the cable arrangement shown there is used with the traveling block arrangement shown in FIG. 3. Shown in FIG. 3 is a modified traveling block are a third cluster of sheaves 60 having an axle 62, a fourth cluster of sheaves 64 having an axle 66. The two axles 62 and 66 are held in a fixed, spaced apart relation by cross member 68 which may be high strength steel. The load line 70 is connected to the center 72 of cross member 68. This center would normally be on the center line of the derrick so that it would be directly above the hole in the ground being drilled or serviced. The third sheave cluster 60 and the fourth sheave cluster 64 of FIG. 3 would normally have the same number of sheaves as a first cluster 36 and second sheave cluster 40, respectively. The live line 20 goes up and over positioning sheave 74 whose axle 76 is supported from support frame 78. The live line 20 goes over the top of sheave 48N of the first cluster down around the corresponding sheave of third sheave cluster 60 and back up over each sheave of the cluster 36 and down to and around each sheave of cluster 60. When the threading of the cable has reached sheave 48A it crosses over to the top of sheave 52A of sheave cluster 40 and down to the sheave cluster 64 and repeated in a like manner as are clusters 36 and 60 until the live cable has reached sheave 52N. The cable then is known as the deadline 26 where it is threaded over support sheave 74 and then down to anchor 28.

The position of the crown block in FIGS. 1 and 3 is such that the center line of the derrick is mid way between the axis of axles 42 and 38. This is a position which the crown block will be in together with the traveling block of FIG. 3, will be in when used where extremely heavy loads are required to be lifted. During other times the arrangement shown in FIG. 2 will be normally used. When it is desired to go from the arrangements of FIGS. 1 and 3 to the arrangement of FIG. 2, the cable 20 is removed from both the crown block and the traveling block then the traveling frame 44 which supports the crown block will be moved to the position shown in FIG. 2. There the center line of the derrick falls on the axis of axle 38. This movement is easily accomplished. The means for accomplishing this includes a hydraulic ram 80 which is connected at one end to anchor 82 on support frame 78 and the extension rod 84 of the ram is connected to the traveling frame 44. A similar hydraulic ram 80A is connected at the other end of traveling frame 44. By properly energizing these two rams the traveling frame 44 can be readily moved between the positions shown in FIGS. 2 and 3. Instead of a hydraulic ram, electrical motors or any other type motors could be used for moving the traveling frame 44. The live cable now is again brought up and threaded over positioning sheave 74, down over sheave 48N to a corresponding sheave of traveling block 30. Traveling block 30 will normally have the same number of sheaves as the sheave cluster 36. The cable will be threaded until all the required individual sheaves in traveling block 30 and in the first sheave cluster 36 have been utilized. When the live line 20 is threaded over sheave 48A it will cross over to a second positioning sheave 75 and it then becomes known as dead line 26 which is anchored to the dead line anchor 28. After the threading of the cable has been completed, the arrangement is in the position shown in FIG. 2 and the derrick is ready to have the usual functions performed.

It is believed clear that by using the crown block of my invention, I can have an arrangement which is quite useful for extremely heavy loads and an arrangement which is useful for normal operations. The arrangement of the cables and the positioning of the crown block of FIG. 1 has twice the mechanical advantage as that of the arrangement of the crown block 10 and the cable arrangement of FIG. 2. The arrangement of FIG. 1 is needed for extremely heavy loads and the arrangement of FIG. 2 is quite adequate for normal loads inasmuch as the traveling block there will move up and down twice as fast as the modified traveling block does in FIG. 3. The extremely heavy loads might be encountered when running very large diameter casings. The lesser loads which would be encountered when using the arrangement of FIG. 2 may be the running of the smaller diameter drill pipes and the smaller diameter casing strings.

Thus, this invention adds versatility to the drilling unit and improve the efficient use thereof.

Figure 4:
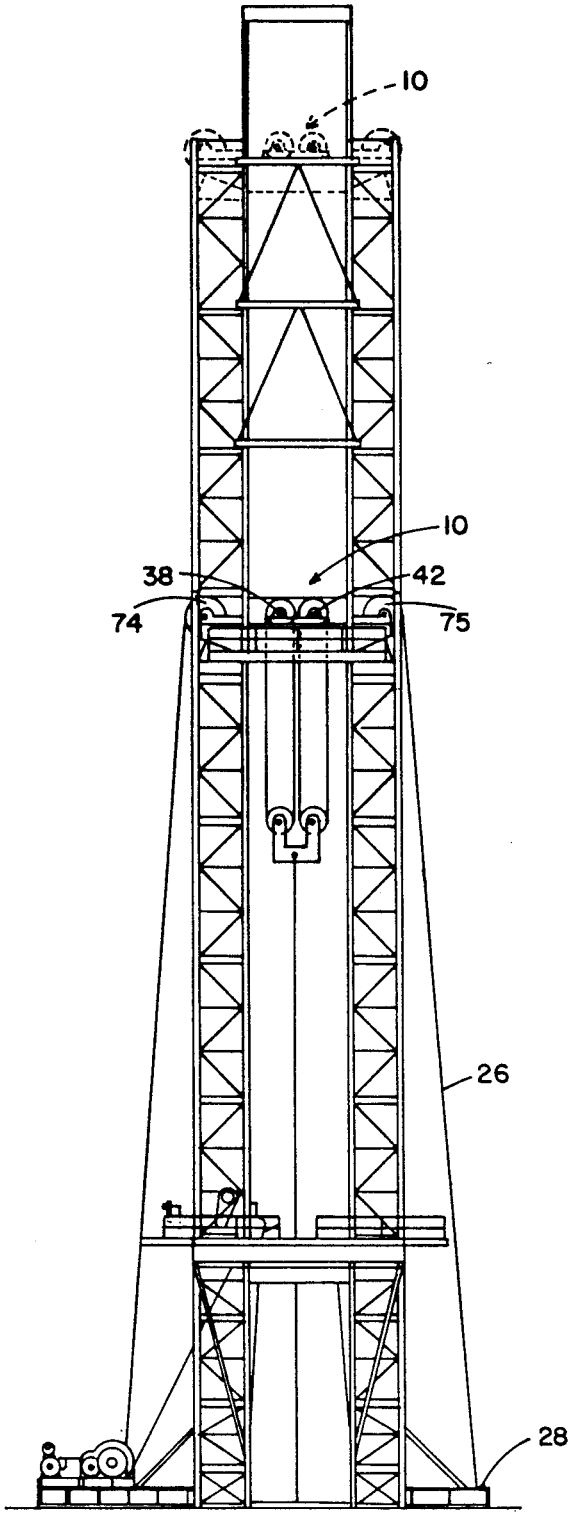
FIG. 4 shows the crown block mounted at the upper end of the lower section of a derrick.

My improved and novel crown block 10 can be used with the derrick of FIG. 4. There the derrick has an upper section A and a lower section B. The structure of the lower section B is built to provide a high strength structure for lifting extremely heavy loads. On top of the lower section B is an upper section A which is lighter weight and not nearly so strong as the lower section B. The heights of sections A and B will depend upon the nature of the loads anticipated to be lifted by the derrick. In some cases the heights of the two sections A and B may be about equal. In normal operations where only lightweight pipe such as a drill string is to be lifted up the derrick I place my crown block 10 at the top of the upper section A. The crown block 10 will be in a position similar to that shown in FIG. 2. The crown block will probably be in this position shown by dotted reference 10 about 90% or more of the time. However, when it is desired to lift something extremely heavy in comparison to the drill pipe, the crown block of my invention will be moved to the position shown in solid line at the upper part of lower section B. As can be seen the crown block has been positioned such that the center of the derrick is between the axles 42 and 38. The modified traveling block shown in FIG. 3 is also utilized. The crown block of FIG. 1 can be raised or lowered between the positions shown at the top of section A and the top of section B in any practical manner such as by the use of helicopter. The support frame 78 can be secured to either the top of section A or the top of section B also by any well known means such as by use of heavy, high strength bolts. In some derricks one side of the derrick is left open so that drilling pipe can be readily removed through what is sometimes called a v-door. This would give adequate room to lower and raise the crown block 10 between the two positions shown in FIG. 4.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of performing drilling operations on a derrick having a lower portion and an upper portion in which the lower portion is designed to withstand a much heavier load than the upper portion which comprises:

providing a crown block at the top of said upper portion of said derrick and supporting a traveling block with cables from said crown block and performing drilling operations;

removing said crown block and traveling block from said upper portion and securing said crown block to the top of said lower portion of the derrick and performing heavy duty operations with the crown block in this latter position.

2. A method as defined in claim 1 in which after the heavy duty operations have been performed removing the crown block and traveling block from said lower portion and raising said crown block to the top of said upper portion and securing said crown block thereto.

3. A method of performing drilling operations on a derrick having a lower portion and an upper portion in which the lower portion is designed to withstand a much heavier load than the upper portion which comprises:

providing a crown block at the top of said upper portion of said derrick and supporting a traveling block with a cable from said crown block and in which said crown block has at least two sheave clusters and a said traveling block having a mating pair of sheave clusters;

performing drilling operations in which said cable extends over one sheave cluster of the crown block and one sheave cluster of the traveling block;

removing said crown block and traveling block from said upper portion and securing said crown block to the top of said lower portion of the derrick;

thereafter utilizing both sheave clusters of said crown block and both sheave clusters of the traveling block to obtain twice the mechanical advantage as when the crown block was at the top of the upper portion of the derrick and then performing heavy duty drilling operations.

* * * * *